US005116027A

United States Patent [19]

Widdowson et al.

[11] Patent Number: 5,116,027

[45] Date of Patent: May 26, 1992

[54] APPARATUS FOR CONTROLLING TEEMING STREAMS

[75] Inventors: Roy Widdowson, Marske, Redcar; Alan Scholes, Nunthorpe, both of Ohio

[73] Assignee: British Steel plc, England

[21] Appl. No.: 518,160

[22] Filed: May 3, 1990

[30] Foreign Application Priority Data

May 3, 1989 [GB] United Kingdom ..... 8910136

[51] Int. Cl.[5] ..... C21C 5/42

[52] U.S. Cl. ..... 266/225; 266/226; 266/236; 266/237; 222/592; 222/597; 164/489

[58] Field of Search ..... 222/592, 597; 266/225, 266/226, 236, 237; 164/466, 475, 415, 337, 505, 489

[56] References Cited

U.S. PATENT DOCUMENTS

| | | | |
|---|---|---|---|
| 2,740,177 | 4/1956 | Smart, Jr. | 164/485 |
| 2,763,040 | 9/1956 | Korb | 164/466 |
| 3,200,457 | 8/1965 | Wagstaff | 164/337 |
| 3,954,134 | 5/1976 | Maas et al. | 164/266 |
| 4,082,207 | 4/1978 | Garnier et al. | 222/594 |
| 4,498,610 | 2/1985 | Wooding | 222/592 |

FOREIGN PATENT DOCUMENTS

| | | | |
|---|---|---|---|
| 1074828 | 2/1960 | Fed. Rep. of Germany | 164/337 |
| 2099189 | 1/1982 | United Kingdom . | |

*Primary Examiner*—Melvyn J. Andrews
*Attorney, Agent, or Firm*—Bacon & Thomas

[57] ABSTRACT

Apparatus for constraining the flow of molten metal from a tundish to a mould along the inner periphery of a tube mounted between them. A vertically movable stopper rod is seated at its lower end in a nozzle at the entrance to the tube the end being so designed as to cause an annular discharge of metal into the tube upon the stopper rod lifting from its seating, gas being injected through the stopper whereby to generate a gaseous void within the interior of the tube to promote the maintenance of the metal flow path of along the length of the inner periphery of the tube.

14 Claims, 6 Drawing Sheets

APPARATUS FOR CONTROLLING TEEMING STREAMS

This invention relates to the control of teeming streams, that is, the flow of molten metal from one receptacle to another, and particularly relates to controlling the flow pattern within a tubular member mounted between the receptacles.

It is an object of this invention to constrain the flow pattern in such a manner as, for example, to increase the surface to volume ratio to facilitate the removal of heat from the molten metal, and/or to influence or control the flow pattern of the molten metal issuing from the tubular member into the other receptacles.

From one aspect the invention provides apparatus for constraining the flow of molten metal from an upper to a lower receptacle along the inner periphery of a tubular member mounted between the receptacles, comprising a vertically movable stopper rod sited in the upper receptacle and seating at its lower end in a nozzle at the entrance to the tubular member, the said end being so designed as to cause an annular discharge of metal into the tubular member upon the stopper rod lifting from its seating, gas being injected through the stopper whereby to generate a gaseous void within the interior of the tubular member to promote the maintenance of the annular flow path of said metal along the length of the inner periphery of said member.

The upper receptacle may be a tundish and the lower receptacle may be a mould of a continuous casting machine.

As mentioned, this invention may be utilised to facilitate the removal of heat from the molten metal stream; this purpose may be enhanced by the provision of a definitive heat exchanger around the flow path through the tubular member—this might be in the form of a water cooled copper tube or e.g. of the type described and illustrated in our UK Pat. No. 2117687B.

In order that the invention may be fully understood some embodiments thereof will now be described, by way of example, with reference to the accompanying drawings, in which.

Figure 1:
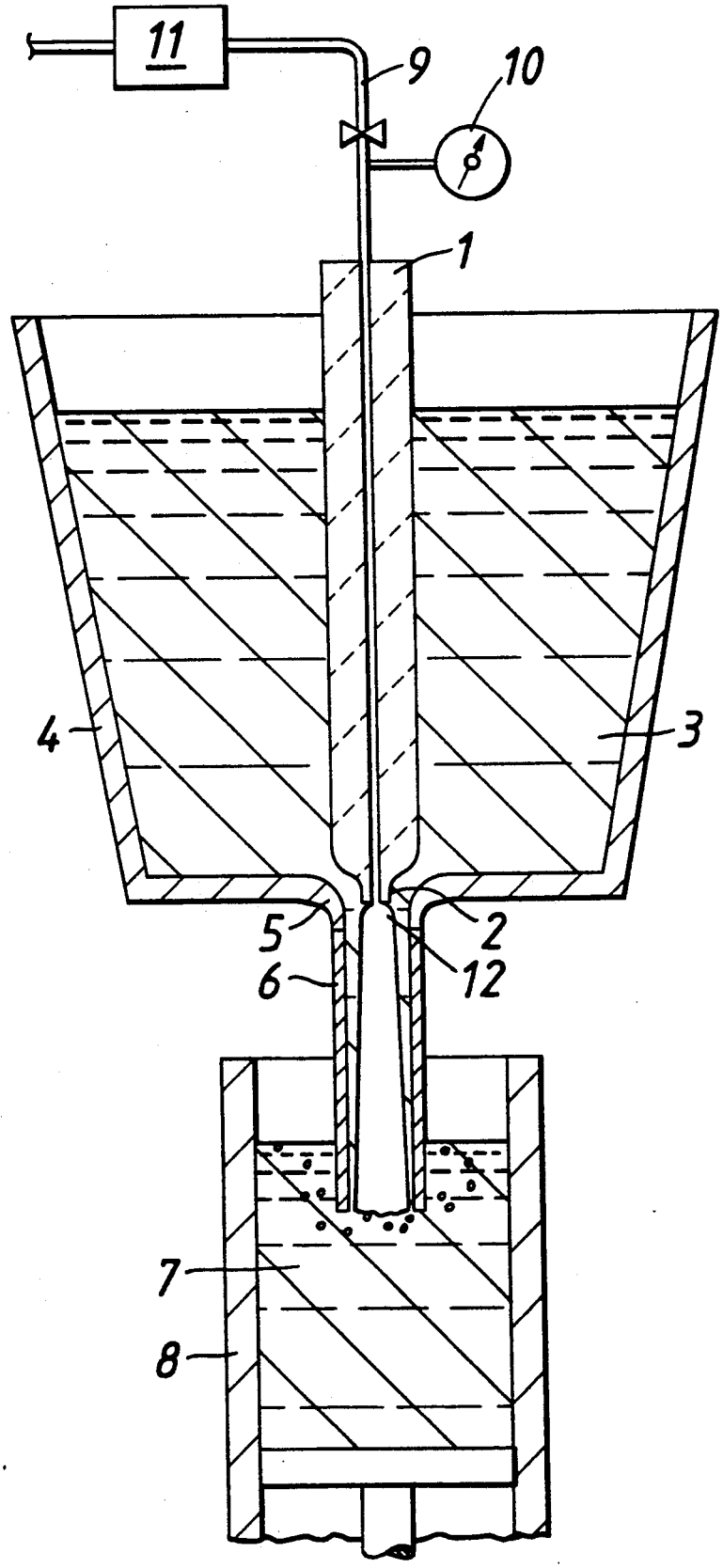
FIG. 1 illustrates the concept of this invention as applied to discharge of molten metal from a tundish to a mould in a continuous casting installation.
Figure 2:
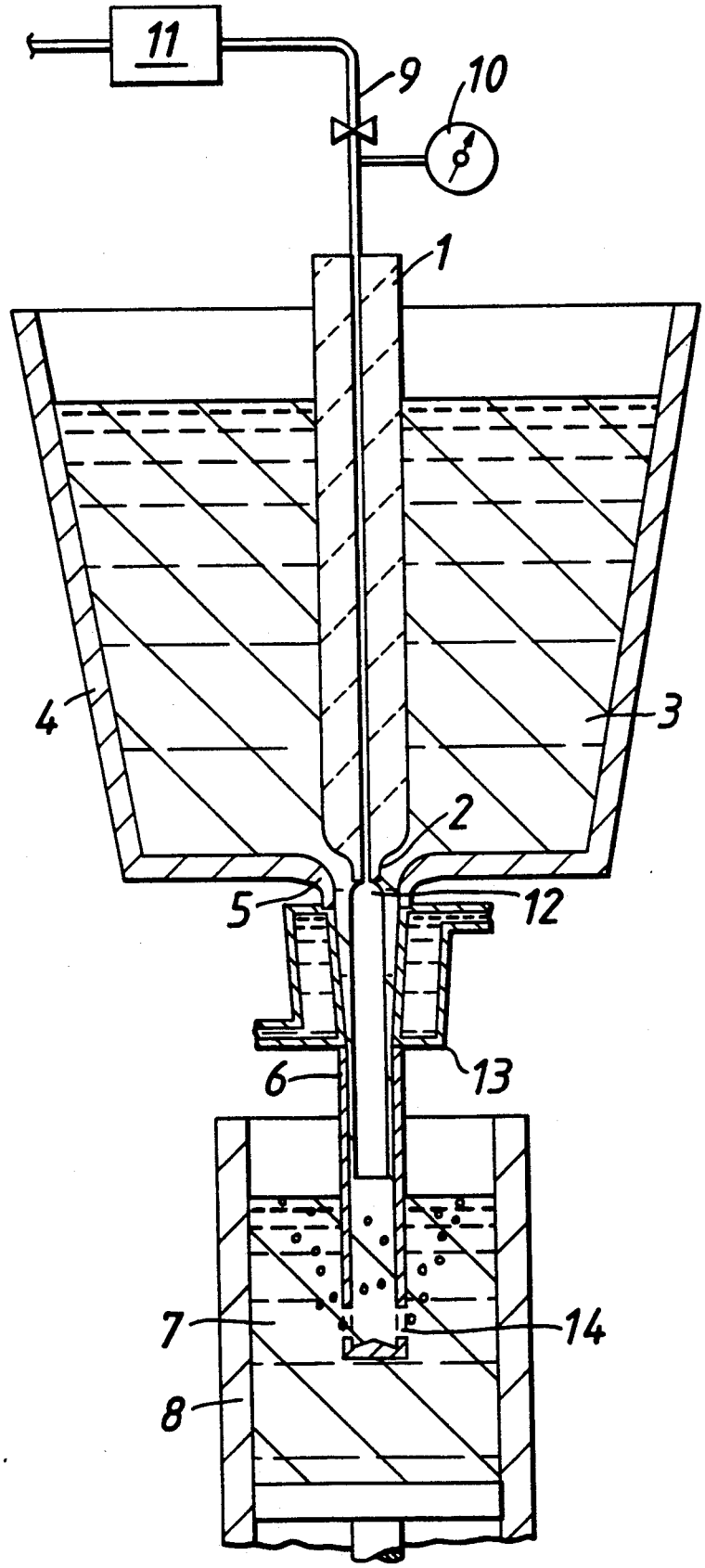
FIG. 2 illustrates a modification of FIG. 1.
Figure 2A:
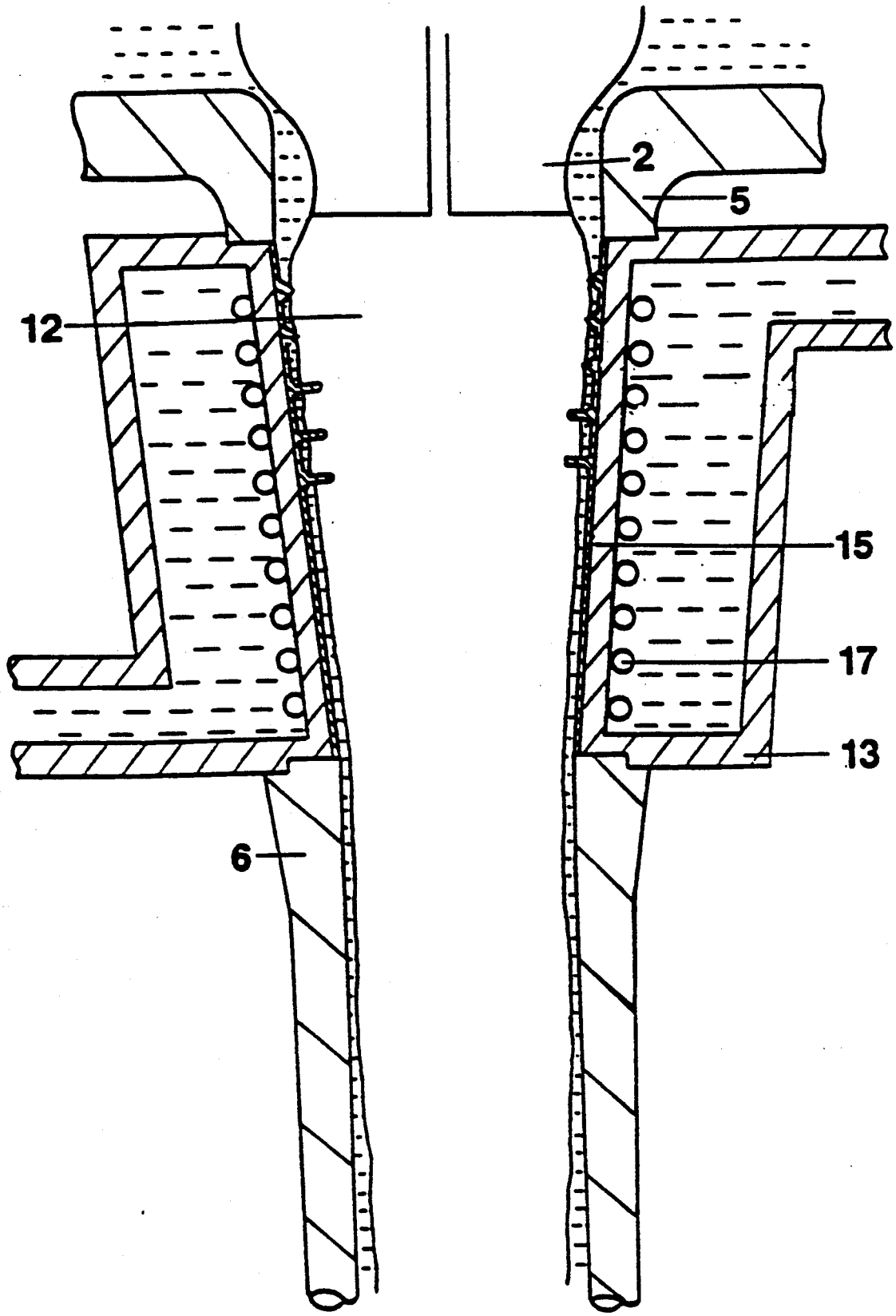
Figure 3A:
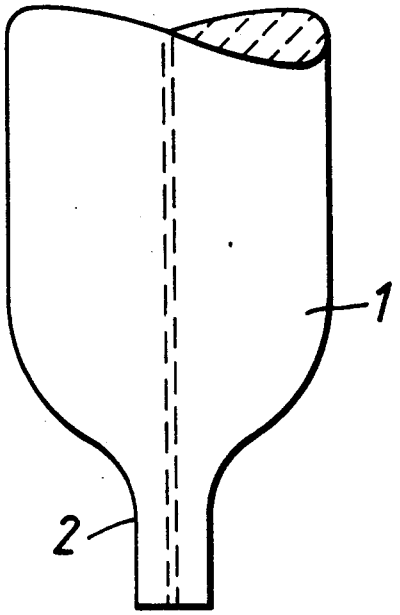
Figure 3B:
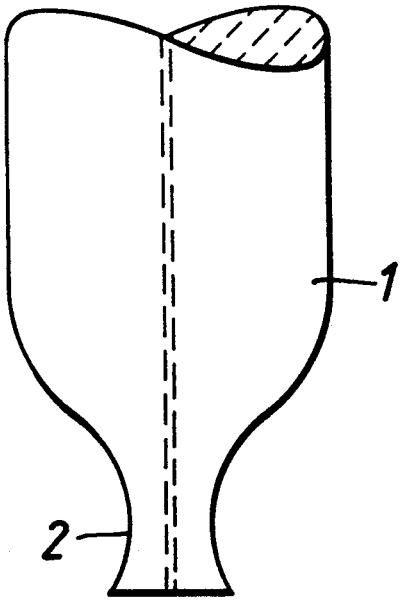
Figure 3C:
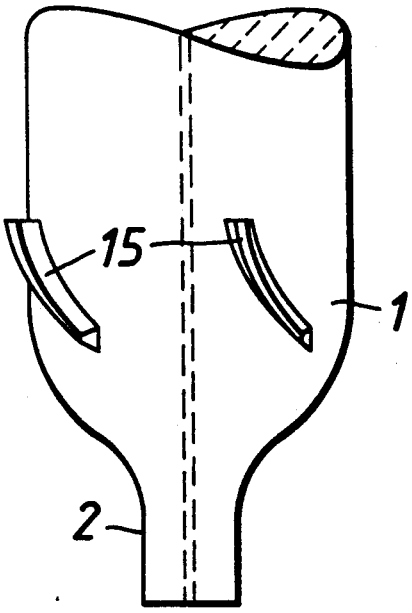
Figure 4:
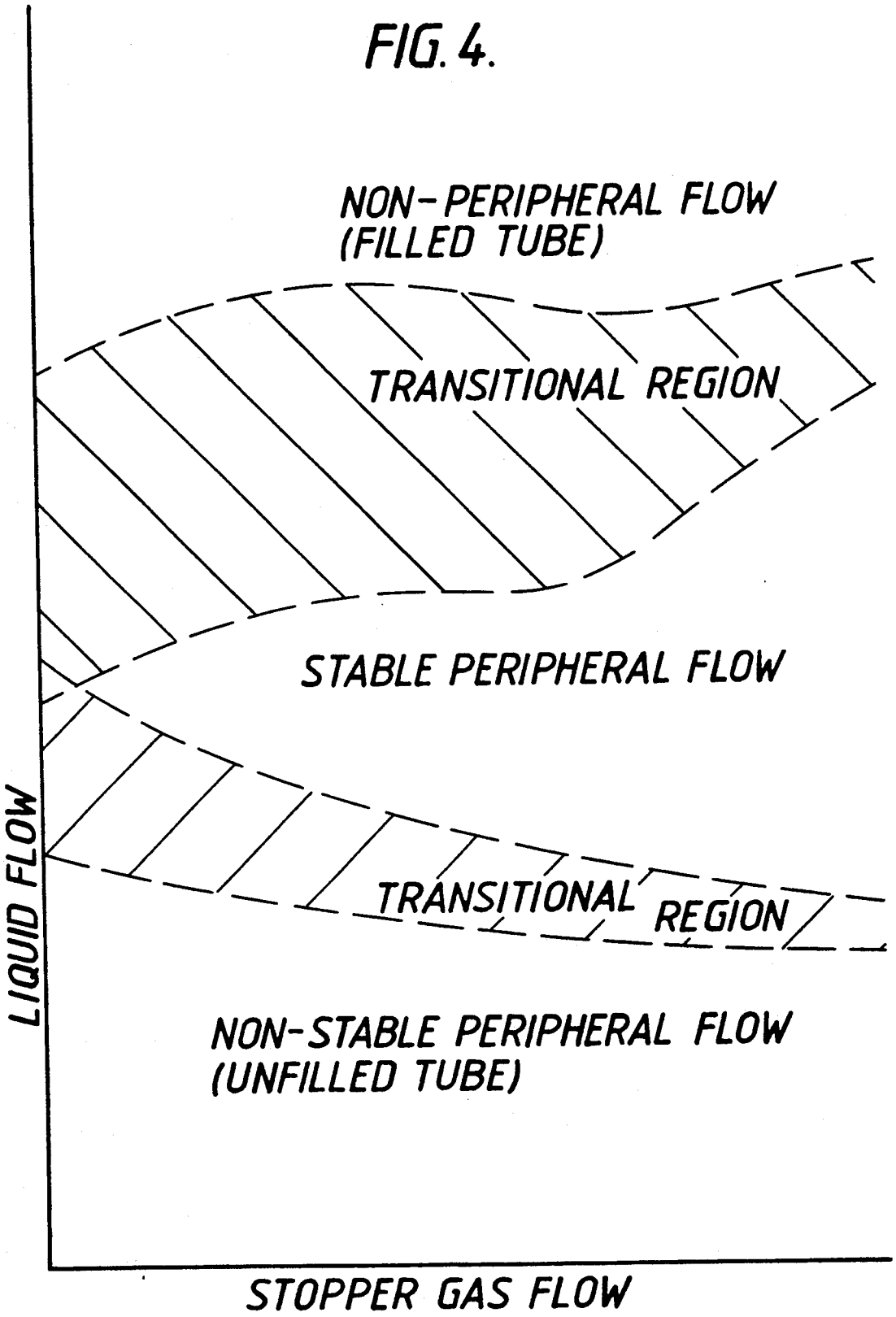
Figure 5:
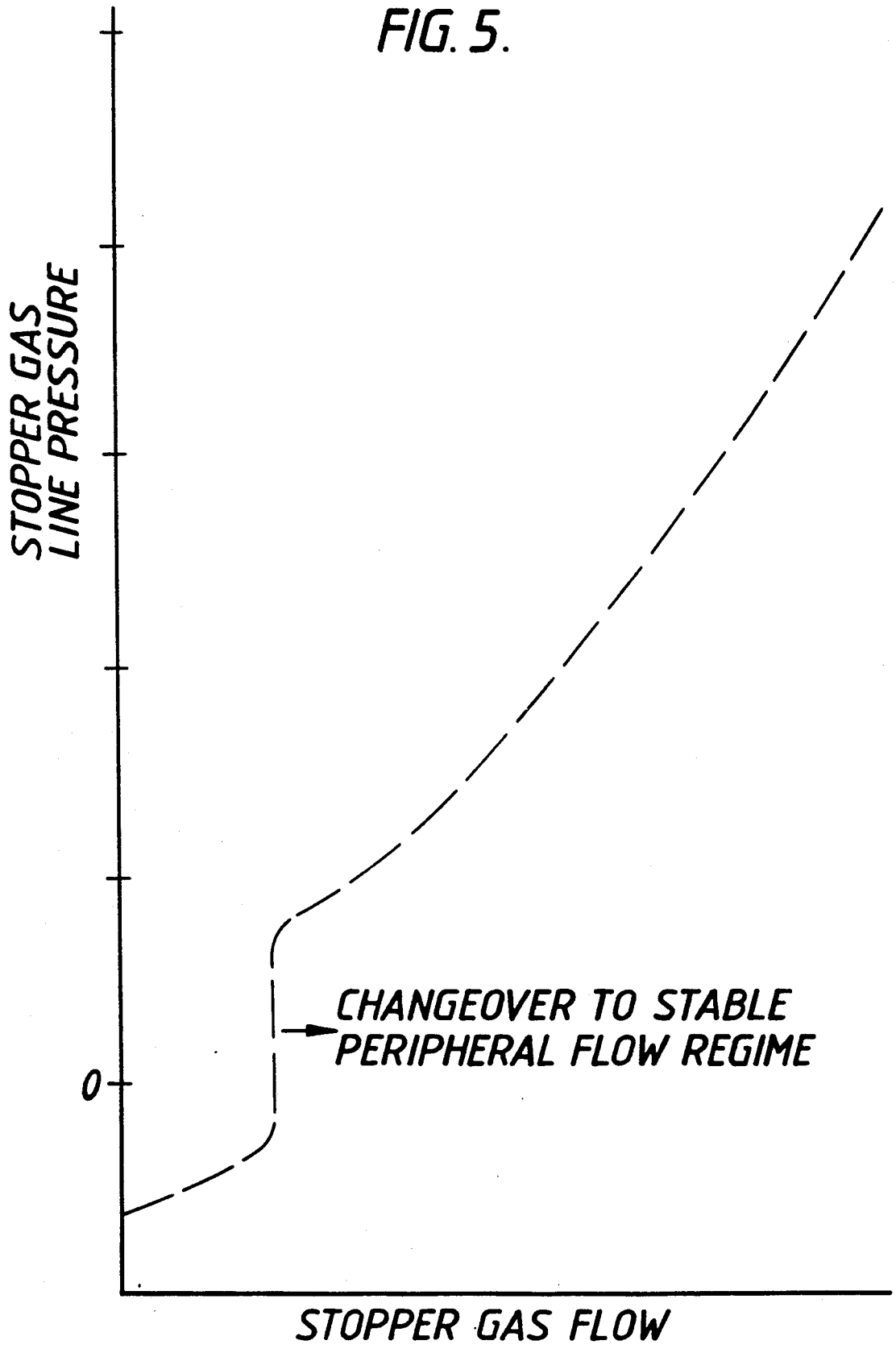

FIG. 2*a* illustrates a modification of the invention depicted in FIG. 1 specifically showing electromagnetic means disposed around the tubular member of the present invention;

FIGS. 3(*a*) to 3(*c*) illustrate different configurations of the stopper rod ends;

FIG. 4 graphically illustrates the balance to be achieved between the molten metal flow and the gas flow to ensure a stable peripheral flow through the pour tube; and FIG. 5 graphically illustrates the manner in which stable peripheral flow can be recognised.

Referring now to FIG. 1, a stopper rod 1 with a shaped tip or end 2 is vertically movable to control the flow rate of molten metal 3 from a tundish 4 through a nozzle 5. An open-ended submerged entry 'pour' tube 6 depends from the nozzle area, feeding the molten stream to a liquid pool 7 within a continuous casting mould 8. Extending axially of the stopper rod 1 is a tube 9 through which an inert gas e.g. argon, is passed under pressure, creating a gaseous void within the tube, this pressure being measured at a tapping position 10 and the gas flow being metered at 11. Both the flow rate and the pressure are controlled within defined limits whereby to promote a peripheral flow pattern of molten steel within the nozzle/submerged entry pour tube as depicted at 12—additionally the gas flow rate must be controlled to avoid detrimental effects of excessive gas volume and flow patterns within the mould.

Referring now to FIG. 2 a similar arrangement is shown save for the utilisation of a heat exchanger 13 intermediate the tundish and the pour tube—which latter component is now shown with a closed end and exit ports 14. The heat exchanger comprises a water cooled copper tube. The tube is preferably tapered, as specifically shown in FIGS. 2 and 2*a*, such that the smaller diameter of the tube is located at the lower end so that any solidified shell formed within it will tend to move downwardly under gravity so as to maintain close contact with the inner wall and enhance heat transfer. The heat exchanger is affixed to the liquid metal feed container above it and is fed via the refractory nozzle 5. Liquid metal exists from the heat exchanger via a pour tube 6, to a second vessel or mold.

The stopper rod end, by which an 'annular' discharge of the molten metal is initially promoted, may, for example, be formed as shown in FIGS. 3(*a*) to 3(*c*). The 'tips' may either be integrally formed with the refractory stopper body or connected as separate items.

In FIG. 3(*a*) the tip is parallel whereas in FIG. 3(*b*) it is 'necked'. In both instances essentially parallel flow is engendered; the tips may be of circular or an ovaloid cross-section. In FIG. 3(*c*) in contrast a swirling flow path is promoted by the provision of arcuate fins 15.

As mentioned, the gas flow rate through the system is closely monitored and the importance of this can be seen with reference to FIG. 4 where, in particular, the achievement of a stable peripheral flow pattern is clearly dependent on the balance of molten metal and gas flow rates, lying as it does between conditions of uneven peripheral flow at low liquid and gas flow rates and non-peripheral flow at very high liquid throughput rates. It has been found in fact that the achievement of the required pattern of stable peripheral flow is characterised by a step change in the pressure within the supply line—see FIG. 5—this phenomenon thus being used as a reference to indicate that stable peripheral flow has been established.

Although this invention has been described with reference to the particular embodiments illustrated it is to be understood that various changes may readily be made without departing from the scope of this invention. For example, a smooth walled pour tube has been shown but this could be profiled, roughened or formed with protrusions, e.g. by sleeving, to enhance turbulence within the peripheral flow. Similar provision could be made within the separate heat exchanger shown in FIG. 2 or indeed in the nozzle. This high degree of turbulence, together with high velocity, are desirable to maximise heat transfer coefficients and minimise shell formation and build-up which might lead to blockages. Alternatively, or additionally, as specifically shown in FIG. 2*a*, electromagnetic means 17, for example an electromagnetic coil disposed around the pour tube, might be utilised to promote turbulent conditions. Additionally, shell formation may be reduced by the application of a low conductivity refractory coating material to the inner surfaces. Moreover it is not essential for the gas line to extend along the axis of the stopper rod, it may conveniently extend through the rod parallel to its axis emerging at the centre of the stopper tip or indeed in a plurality of orifices at the tip, e.g. for inducing peripheral flow.

We claim:

1. Apparatus for constraining the flow of molten metal from an upper to a lower receptacle along the inner periphery of a tubular member mounted between the receptacles, comprising a vertically movable stopper rod sited in the upper receptacle and seating at its lower end in a nozzle at the entrance to the tubular member, the said end being so designed as to cause an annular discharge of metal into the tubular member upon the stopper rod lifting from its seating, and means for injecting gas through the stopper whereby the generate a gaseous void within the interior of the tubular member to promote the maintenance of the annular flow path of said metal along the length of the inner periphery of said member.

2. Apparatus according to claim 1, comprising a heat exchanger disposed around the exterior of the tubular member.

3. Apparatus according to claim 1, in which that part of the tubular member adjacent the nozzle is constituted by a heat exchanger.

4. Apparatus according to claim 3, in which the heat exchanger comprises an inwardly tapered water-cooled copper tube.

5. Apparatus according to claim 3, in which the inner surface of the heat exchanger is coated with a low conductivity refractory material.

6. Apparatus according to claim 1, in which the inner surface of the tubular member is profiled to promote turbulent peripheral flow.

7. Apparatus according to claim 1, comprising electromagnetic means disposed around the tubular member to promote turbulent peripheral flow.

8. Apparatus according to claim 1, in which the annular discharge is promoted by the said end of the stopper rod being formed with a dependent tip which extends into the nozzle.

9. Apparatus according to claim 8, in which the tip is of circular or ovaloid cross-section.

10. Apparatus according to claim 9, in which the tip is necked to promote a divergent flow.

11. Apparatus according to claim 9, in which arcuate fins are provided adjacent the end of the stopper rod to promote a swirl in the discharged metal.

12. Apparatus for constraining the flow of molten metal from an upper to a lower receptacle along the inner periphery of a tubular member mounted between the receptacles, comprising a vertically movable stopper rod sited in the upper receptacle and seating at its lower end in a nozzle at the entrance to the tubular member, the said end having a dependent tip which extends into the nozzle so as to cause an annular discharge of metal into the tubular member upon the stopper rod lifting from its seating, means for injecting gas through the stopper whereby to generate a gaseous void within the interior of the tubular member to promote the maintenance of the flow path of said metal along the length of the inner periphery of said member, and means for promoting turbulence to said peripheral flow.

13. Apparatus according to claim 12, in which at least that part of the tubular member adjacent the nozzle is constituted by a heat exchanger.

14. Apparatus according to claim 13, in which the inner surface of the heat exchanger is coated with a low conductivity material.

* * * * *

UNITED STATES PATENT AND TRADEMARK OFFICE

CERTIFICATE OF CORRECTION

PATENT NO. : 5,116,027

DATED : May 26, 1992

INVENTOR(S) : Roy WIDDOWSON and Alan Scholes

It is certified that error appears in the above-identified patent and that said Letters Patent is hereby corrected as shown below:

On the Title Page Item:

[75] Inventors: Roy Widdowson, Marske, Redcar; Alan Scholes, Nunthorpe, both of England Signed and Sealed this Fifth Day of October, 1993

Bruce Lehman

*Attest:*

BRUCE LEHMAN

*Attesting Officer*

*Commissioner of Patents and Trademarks*